US008641550B2

(12) United States Patent
Golden et al.

(10) Patent No.: US 8,641,550 B2
(45) Date of Patent: Feb. 4, 2014

(54) GOLF CLUB HEADS

(75) Inventors: Charles E. Golden, Carlsbad, CA (US); Douglas E. Roberts, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 721 days.

(21) Appl. No.: 12/644,051

(22) Filed: Dec. 22, 2009

(65) Prior Publication Data

US 2011/0151989 A1 Jun. 23, 2011

(51) Int. Cl.
*A63B 53/04* (2006.01)

(52) U.S. Cl.
USPC ..... 473/291; 473/349; 473/345

(58) Field of Classification Search
USPC ..... 473/290–291, 345–346, 349
See application file for complete search history.

(56) References Cited

U.S. PATENT DOCUMENTS 4,630,825 A * 12/1986 Schmidt et al. ..... 473/287
4,732,389 A * 3/1988 Kobayashi ..... 473/348
4,874,171 A * 10/1989 Ezaki et al. ..... 473/290
5,643,107 A * 7/1997 Gorman ..... 473/328
6,074,310 A 6/2000 Ota
6,599,202 B2 * 7/2003 Miyamoto ..... 473/289
7,070,512 B2 * 7/2006 Nishio ..... 473/319
2003/0032500 A1 * 2/2003 Nakahara et al. ..... 473/345
2007/0042836 A1 2/2007 Best et al.
2009/0181789 A1 7/2009 Reed et al.

* cited by examiner

*Primary Examiner* — Stephen L. Blau
(74) *Attorney, Agent, or Firm* — Mark S. Leonardo; Brown Rudnick LLP

(57) ABSTRACT

A plurality of golf club heads wherein the difference in spin is minimized is disclosed herein. More specifically, the present invention discloses a plurality of fairway wood type golf club head with a volume of between about 110 cubic centimeters (cc) and about 250 cc, wherein the change in backspin between any two clubs within the plurality of metal wood type golf club heads is less than about 600 revolutions per minute (rpm). A plurality of golf clubs in accordance with the present invention may generally have all of its clubs maintain a center of gravity (CG) location that is less than about 8.0 mm away from a neutral axis of the golf club head regardless of the difference in loft of the specific golf club head within the plurality of golf club heads.

14 Claims, 6 Drawing Sheets

GOLF CLUB HEADS

FIELD OF THE INVENTION

The present invention relates generally to a plurality of golf club heads wherein the difference in spin generated by each and every one of the golf club head is minimized. More specifically, the present invention relates to a plurality of metal wood type golf club heads with a volume of between about 110 cubic centimeters (cc) and about 250 cc, wherein the change in backspin between any two clubs within the plurality of metal wood type golf club heads is less than about 600 revolutions per minute (rpm). Even more specifically, the present invention relates to a plurality of fairway wood type golf club heads wherein all golf club heads have a Center of Gravity (CG) location that is less than about 8.0 mm away from a neutral axis of the golf club head creating a spin to loft ratio that decreases as the loft increases; resulting in a spin to loft ratio change of less than about 10 rpm/degrees between the clubs.

BACKGROUND OF THE INVENTION

In order to successfully navigate through the challenges of a golf course, a golfer may utilize different golf clubs designed to achieve different objectives encountered throughout the golf course. For example, one of the major objectives of a golfer during a round of golf is to drive a golf ball as far as they can. A driver type golf club is generally used to accomplish this objective by maximizing the distance of a golf shot from a tee box utilizing a golf tee that improves the quality of contact with the golf ball. On the opposite end of the spectrum, one of the other objectives of golf is to accurately get the golf ball into a cup to complete a hole. A putter type golf club is generally used to accomplish this second objective by gently guiding the golf ball into the cup, thus requiring a maximum emphasis on accuracy. Between the two above mentioned objectives are numerous other objectives requiring a golfer to use a multitude of different clubs. Generally speaking, one of the other major objectives within the game of golf is to get a golf ball as close to the cup as possible, thus requiring a balance between distance and accuracy for the specific distance range required. Iron type golf clubs have been the predominant golf club of choice for a golfer that wishes accomplish this third objective mentioned above, as iron type golf clubs strive for a balance of accuracy and distance of a golf shot depending on the exact distance needs of the golfer.

However, even with the existence of driver type golf club heads, iron type golf club heads, and putter type golf club heads, golf courses present numerous other challenges that may or may not be capable of being addressed by the above mentioned clubs. For example, in addition to the difficulties in getting the golf ball from the tee box to the cup, golf courses may offer numerous additional challenges such as sand traps, tall roughs, trees, lakes, rivers, oceans, waterfalls, long par 5's, or even stone walls in the middle of a golf course that may require specialized golf clubs to help a golfer overcome these additional challenges. In order to address these additional challenges of the golf course, specialized golf clubs have been created to help a golfer tackle these additional challenges of the golf course. The sand wedge, with its heavy weight, sharper edges, and higher lofts, is one example of such a club that makes it a easier for a golfer to escape the sand traps of a golf course. Fairway woods, on the other hand, have been developed to help the golfer address the difficulty encountered when he or she needs to hit a golf ball over a significantly long distance, especially when the golfer finds the golf ball at a location that does not allow the use of a golf tee.

Fairway woods are a particular type of golf club that, similar to drivers, places an emphasis on maximizing the distance of a golf shot. Fairway woods, however, are different than drivers in that they may be used to hit a golf ball resting on the ground with or without a golf tee. Fairway woods, because of their need to be able to maximize performance off the ground without a golf tee, may generally have a smaller size, allowing the club to effectively get under and engage a golf ball resting on the ground.

Because of the success and wide acceptance of fairway wood type golf clubs in helping the golfer overcome one of the most common challenges of a golf course as mentioned above, numerous attempts have been made improve the performance of the fairway wood type golf club by lowering the center of gravity of the club to provide a better ball flight and allow the golf club to better get under and engage a golf ball. U.S. Pat. No. 6,074,310 ('310 patent) to Ota provides one example of this by disclosing a golf club head defining a face, a lower sole portion, an upper portion, and a side wall. The sole portion of the '310 patent is generally thicker than the upper portion, and preferably approximately one and one-third to six times as thick, resulting in a lower center of gravity that allows a golfer to more easily swing the face of the club head under a golf ball.

Another way to improve the performance of a fairway wood is to create a fairway wood type golf club head with a higher moment of inertia to provide even more forgiveness. More specifically, the prior art technology could utilize strategic weight placement at extreme ends of the fairway wood type golf club head to prevent twisting of the golf club head. This ability of a golf club head to resist twisting upon impact may generally increase the moment of inertia of a golf club head, yielding a fairway wood type golf club head that is more accurate regardless of the impact location.

Due to the versatility and enhanced performance capabilities of fairway wood type golf clubs, fairway woods have gained prominent acceptance with golfers. In fact, golfers have found fairway woods so appealing, the golfing industry have expanded their fairway wood offerings to include multiple fairway woods with different lofts to help golfers achieve different types of golf shots all within the realm of maintaining the basic premise of hitting the golf ball a significant distance. Because of the multiple offerings as well as their increased performance benefits, it is not uncommon for a golfer to carry multiple fairway woods to help him or her navigate the difficulties of a golf course. However, because of the inherent design limitations of fairway woods stemming from their smaller size, fairway woods that vary from one another in terms of loft may generally be accompanied by significant changes in terms of its size, volume, and shape that could alter the performance of the fairway wood.

Despite tremendous technological advancements within fairway wood technology to help the golfer navigate the added length of a golf course, the advancements within the fairway wood technology have been in a vacuum, focusing on individual clubs instead of controlling the variables that deprive the entire set of fairway type golf clubs from achieving the maximum distance that the club is capable of. More specifically, because of the difference in size, volume, and shape, the amount of spin generated by the higher lofted fairway wood type golf clubs may generally be significantly higher, robbing the higher lofted fairway wood type golf clubs of distance.

Hence, it can be seen from above there is a need in the field for a plurality of fairway woods that maximizes the distance of each and every single club within the set. More specifically, there is a need in the field for a set of fairway woods that minimizes the spin variation between the different fairway wood type golf club heads despite the fact that each of the individual fairway wood type golf club heads may have different lofts.

BRIEF SUMMARY OF THE INVENTION

One aspect of the present invention is a plurality of golf club heads comprising a first golf club head and a second golf club head. The first golf club head further comprises a first striking face located at a front portion of the first golf club head and the first striking face has a first loft angle of greater than about 14 degrees and less than about 24 degrees. The first striking face also has a first face center defining a first neutral axis normal to the first striking face passing through the first face center. The first golf club head also has a first center of gravity located at a first CG location distance away from the first neutral axis. The second golf club head further comprises a second striking face located at a front portion of the second golf club head and the second striking face has a second loft angle of greater than about 14 degrees and less than about 24 degrees. The second striking face also has a second face center defining a second neutral axis normal to the second striking face passing through the second face center. The second golf club head also has a second center of gravity located at a second CG location distance away from the second neutral axis. The first golf club head and the second golf club head both have a volume of greater than about 110 cc and less than about 250 cc, and the difference between the first CG location distance and the second CG location distance is less than about 1.00 mm. The CG location distance is calculated from a line that runs normal to the neutral axis through the CG location.

In another aspect of the present invention is a golf club head comprising a striking face located at a front portion of the golf club head and the striking face has a first loft angle of greater than about 14 degrees and less than about 24 degrees. The striking face also has a face center defining a neutral axis normal to the striking face passing through the face center. The golf club head also has a center of gravity located at a CG location distance away from the neutral axis, wherein the golf club head has a volume of greater than about 110 cc and less than about 250 cc, and wherein the CG location distance is less than about 8.0 mm. The CG location distance is calculated from a line that runs normal to the neutral axis through the CG location.

In a further aspect of the present invention is a plurality of golf club heads comprising a first golf club head and a second golf club head. The first golf club head further comprises a first striking face located at a front portion of the first golf club head and the first striking face has a first loft angle of greater than about 14 degrees and less than about 24 degrees. The first striking face also has a first face center defining a first neutral axis normal to the first striking face passing through the first face center. The first golf club head also has a first center of gravity located at a first CG location distance away from the first neutral axis. The second golf club head further comprises a second striking face located at a front portion of the second golf club head and the second striking face has a second loft angle of greater than about 14 degrees and less than about 24 degrees. The second striking face also has a second face center defining a second neutral axis normal to the second striking face passing through the second face center. The second golf club head also has a second center of gravity located at a second CG location distance away from the second neutral axis. The first golf club head and the second golf club head both have a volume of greater than about 110 cc and less than about 250 cc, and the difference in a volume to CG location distance ratio between the first golf club head and the second golf club head is less than about 50 $cm^2$, wherein the volume to CG location distance ratio is defined as the volume of the golf club head divided by the center of gravity location measured away from the neutral axis. The CG location distance is calculated from a line that runs normal to the neutral axis through the CG location.

These and other features, aspects, and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
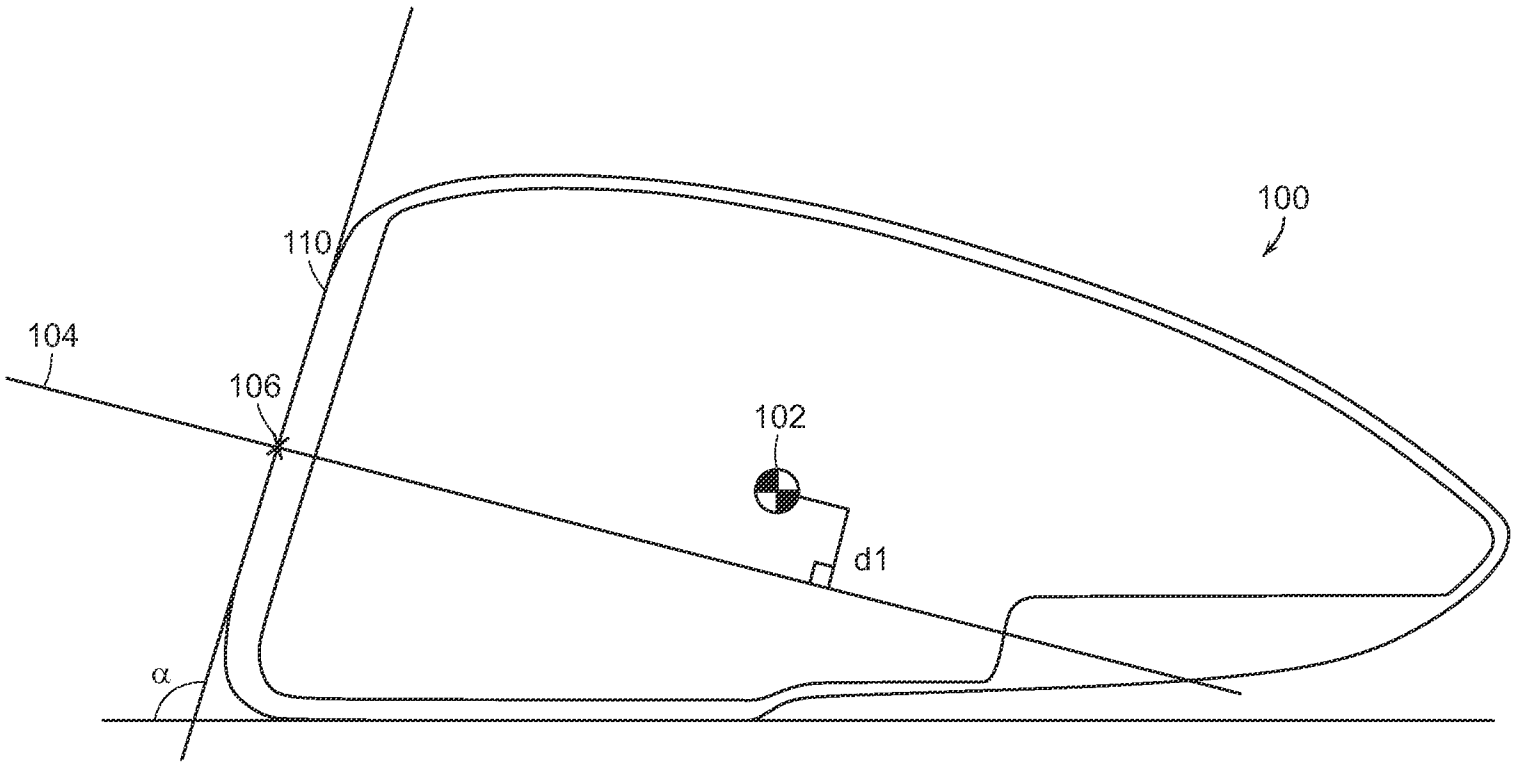
FIG. 1 (Prior Art)
FIG. 1 is a cross-sectional view of a prior art 3 fairway wood type golf club head.
Figure 2:
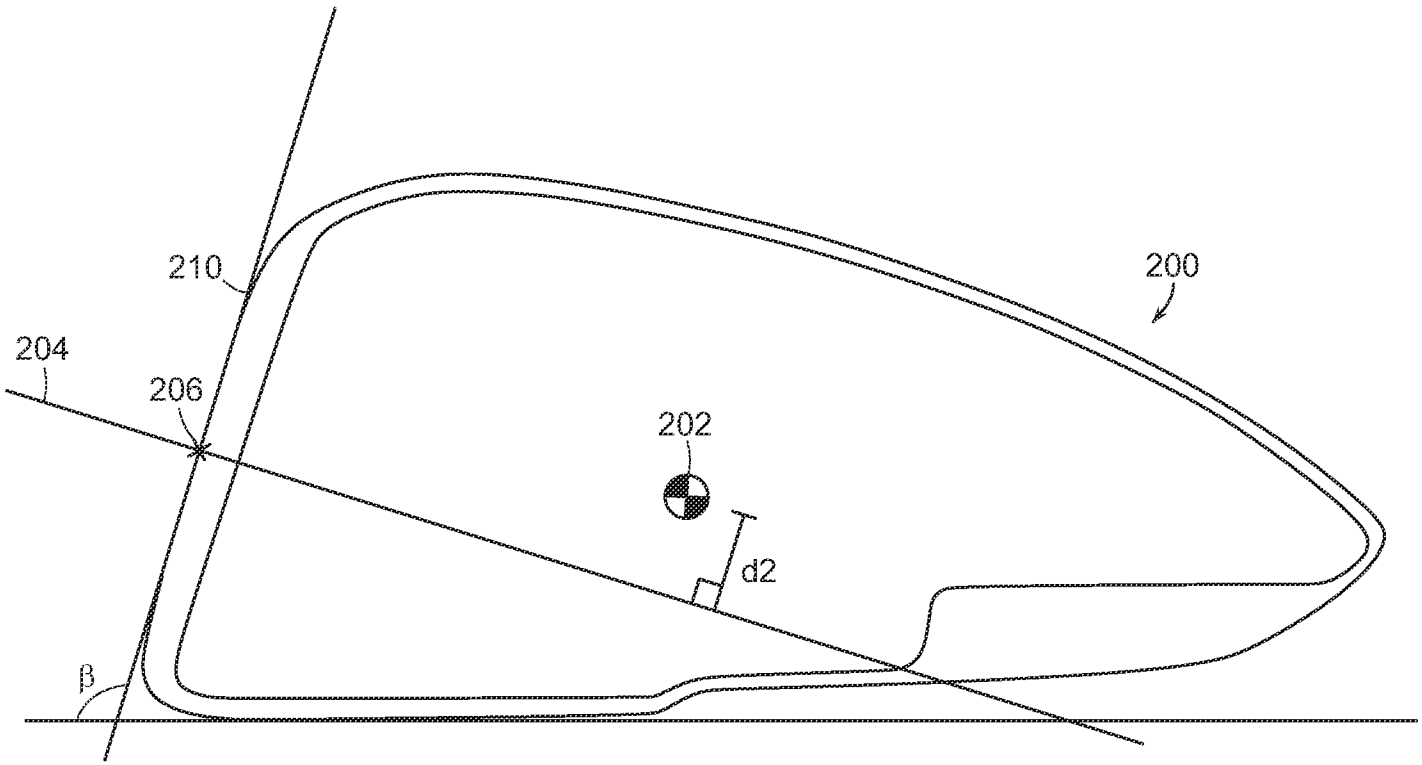
FIG. 2 (Prior Art)
FIG. 2 is a cross-sectional view of a prior art 5 fairway wood type golf club head.
Figure 3:
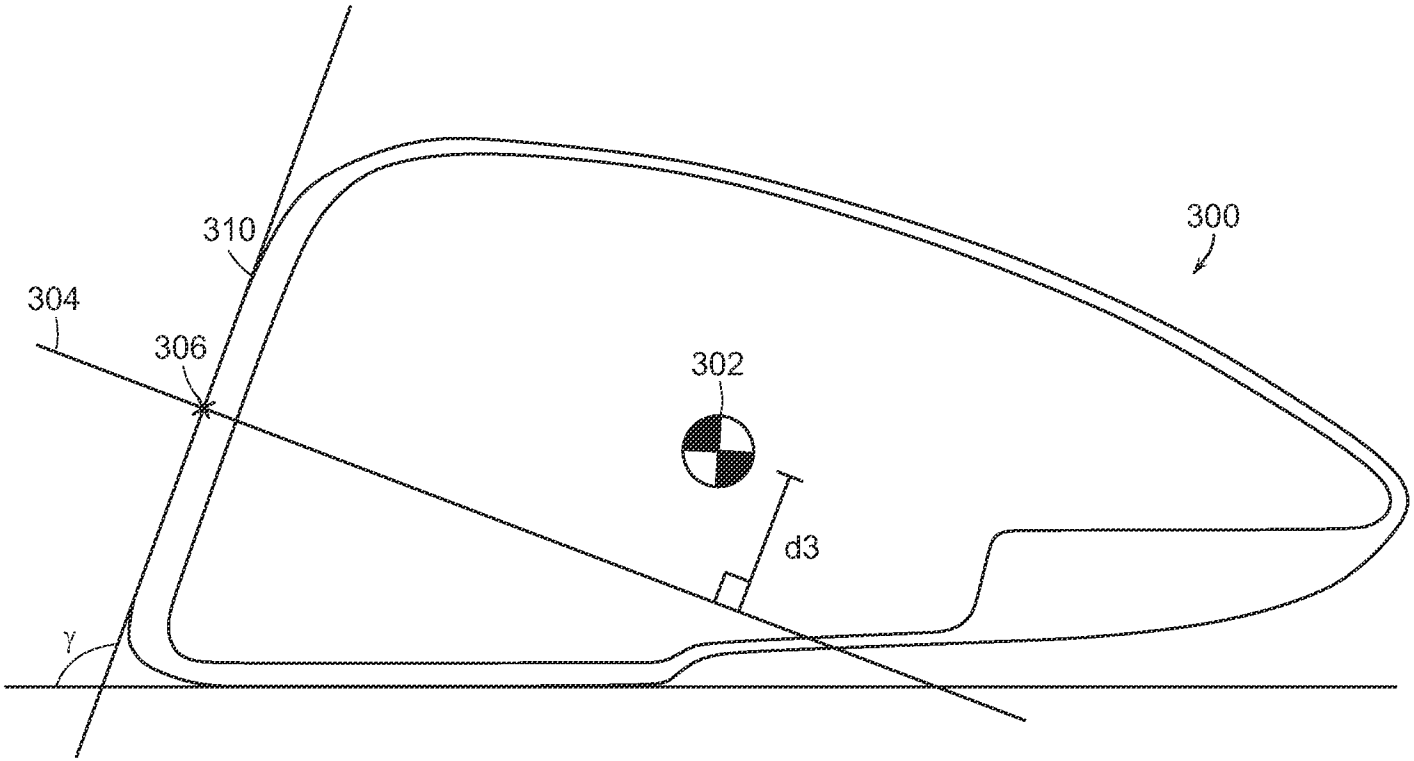
FIG. 3 (Prior Art)
FIG. 3 is a cross-sectional view of a prior art 7 fairway wood type golf club head.

FIGS. 1-3 shown here refer to a plurality of prior art golf club heads wherein the Center of Gravity (CG) location is driven primarily by the size and shape of the golf club heads 100, 200, and 300, causing the backspin rate to fluctuate significantly between golf club heads 100, 200, and 300. More specifically, because of the significant fluctuation in the backspin rate between golf club heads 100, 200, and 300, the performance of these golf club heads are compromised, resulting in a loss of distance. Golf club head 100, shown here in FIG. 1, may generally resemble a prior art 3 fairway wood type golf club head with a loft of about 16 degrees. Golf club head 200, shown here in FIG. 2, may generally resemble a prior art 5 fairway wood type golf club head with a loft of about 18 degrees. Golf club head 300, shown here in FIG. 3, may generally resemble a prior art 7 fairway wood type golf club with a loft of about 20 degrees.

Turning now to FIG. 1, showing a prior art 3 fairway wood type golf club head 100, we can see that the 3 fairway wood type golf club head 100 may have a loft angle α. As already described above, a 3 fairway wood type golf club head 100 may generally have a loft angle of about 16 degrees, indicating that it may generally be the least lofted club within the set of fairway wood type golf club heads. FIG. 1 also shows a CG 102 location within the body of the golf club head 100. More specifically, the CG 102 is located at a "CG Location Distance" d1 away from a neutral axis 104 of the golf club head 100. The neutral axis 104 of a golf club head 100 may generally be defined as the axis that passes through the center 106 of the striking face 110 of the golf club head 100, while being normal to the striking face 110 that has a loft angle α. It is worth noting that in this prior art golf club head 100, the "CG Location Distance" d1, as specifically referred to herein, signifies the location of the CG 102 away from the neutral axis 104, measured from a point that is normal to the neutral axis 104. "CG Location Distance" d1, as referred to in this prior art embodiment in FIG. 1 may generally be about 5.6 mm. Prior art 3 fairway wood type golf club head 100 may generally have a volume of about 165 cc. Finally, it may be worthwhile to note that the amount of backspin generated by this prior art 3 fairway wood type golf club head 100 may generally be about 3600 revolutions per minute (rpm), when the golf club head is swung with a velocity of about 80 to 85 miles per hour (mph) with an attack angle of between about −2 degrees to about 2 degrees.

FIG. 2 shows a prior art 5 fairway wood type golf club head 200 with a loft angle β. As already described above, a 5 fairway wood type golf club head 200 may generally have a loft angle of about 18 degrees, making it a balanced fairway wood type golf club head 200 in terms of distance and accuracy. It is worth noting that within the prior art, the "CG Location Distance" d2 between the CG 202 location and the neutral axis 204 may generally be greater than "CG Location Distance" d1. More specifically, the "CG Location Distance" d2 may generally be about 7.5 mm, causing this prior art 5 fairway wood type golf club head 200 to generate significantly more backspin than a 3 fairway wood type golf club head 100 shown in FIG. 1. This increase in backspin between the 5 fairway wood type golf club head 200 and the 3 fairway wood type golf club head 100 may be undesirable because excessive backspin deprives the golf shot of distance. Prior art 5 fairway wood type golf club head 200 may generally have a volume of about 160 cc. It may also be worthwhile to note that the amount of backspin generated by this prior art 5 fairway wood type golf club head 200 may generally be about 4500 rpm, wherein the golf club head is swung with a velocity of about 80 to 85 mph with an attack angle of between about −2 degrees to about 2 degrees.

FIG. 3 shows a prior art 7 fairway wood type golf club head 300 with a loft angle γ. Similar to what has already been discussed above, a 7 fairway wood type golf club head 300 may generally have a loft angle of about 20 degrees, making it a high lofted fairway wood type golf club head 300. It is worth noting that within the prior art, the "CG Location Distance" d3 between the CG 302 location and the neutral axis 304 may generally be greater than d1 or d2. More specifically, the "CG Location Distance" d3 may generally be about 9.5 mm, causing this prior art 7 fairway wood type golf club head 300 to generate significantly more backspin than a 3 fairway wood type golf club head 100 and the 5 fairway wood type golf club head 200 shown in FIG. 1 and FIG. 2. Prior art 7 fairway wood type golf club head 300 may generally have a volume of about 150 cc. It may also be worthwhile to note that the amount of backspin generated by this prior art 7 fairway wood type golf club head 300 may generally be about 5400 rpm, when the golf club head is swung with a velocity of about 80 to 85 mph with an attack angle of between about −2 degrees to about 2 degrees.

Looking at the amount of spin generated by the prior art fairway wood type golf club heads 100, 200, and 300, one may observe that the 5 fairway wood type golf club head 200 may generate about 900 rpm more backspin than the 3 fairway wood type golf club head 100. Additionally, it may also be apparent from the above the 7 fairway wood type golf club head 300 also generates about 900 rpm more backspin than the 5 fairway wood type golf club head 200. This dramatic increase in backspin between the different clubs could be detrimental to the overall performance of these fairway wood type golf club heads as such a dramatic increase in backspin may deprive the higher lofted fairway wood type golf club heads of distance. Additionally, with such a dramatic increase in backspin between the different clubs, the trajectory of a golf shot bit by these different clubs may become dramatically different, making them less predictable relative to each other.

Looking at FIGS. 1, 2, and 3, it can also be observed that prior art golf clubs have a dramatic change in CG location distance from the neutral axis amongst the different fairway wood type golf clubs within the plurality of golf club heads. More specifically, the difference between the "CG location distance" d1, d2, and d3 may generally be greater than about 1.00 mm Take for example, the difference between "CG Location Distance" d1 and distance d2 may generally be about 1.74 mm while the "CG Location Distance" between d2 and d3 may generally be about 2.17 mm. The dramatic change in CG location distances d1, d2, and d3 may be one of the factors that contributes to the undesirable effect described above of having a large spin variation between the various fairway wood type golf club heads. Having such a large spin variation may be undesirable in a golf club because golf shots may tend to balloon when a higher lofted club generates too much spin, robbing the golfer of distance.

FIGS. 4-7, on the other hand, shows a plurality of fairway wood type golf club heads in accordance with an exemplary embodiment of the present invention when a conscious effort has been taken to strategically place the CG location at a location that is relatively constant throughout the plurality of fairway wood type golf club heads. More specifically, the CG location of the plurality of fairway wood type golf club heads may generally all be within 8.0 mm away from the neutral axis. Even more specifically, the change in the CG location distance from the neutral axis between any club within the plurality of fairway wood type golf club heads may generally be less than about 1.25 mm, more preferably less than about 1.0 mm, and most preferably less than about 0.75 mm. Ultimately, a 3 fairway wood type golf club head 400 may have a CG 402 location distance d4 of about 7.2 mm, a 5 fairway wood type golf club head 500 may have a CG 502 location distance d5 of about 7.7 mm, and a 7 fairway wood type golf club head 600 may have a CG 602 location distance d6 of about 7.9 mm away from a neutral axis of the fairway wood type golf club head.

Figure 4:
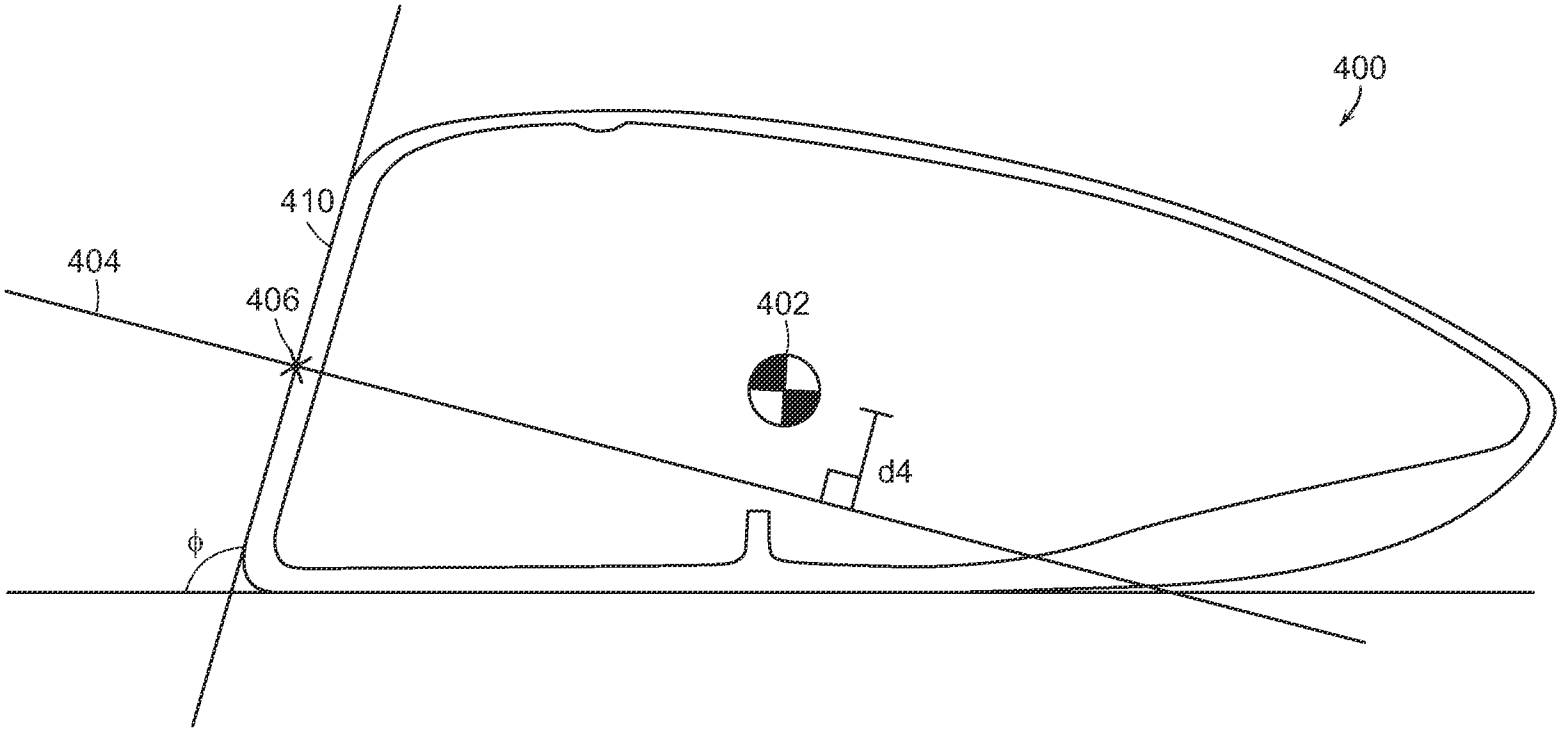
FIG. 4 is a cross-sectional view of a 3 fairway wood type golf club head in accordance with an exemplary embodiment of the present invention.

FIG. 4 shows a 3 fairway wood type golf club head 400 in accordance with an exemplary embodiment of the present invention with a loft angle Φ. Because FIG. 4 shows a 3 fairway wood type golf club head 400, the loft angle Φ in accordance with an exemplary embodiment of the present invention may generally be greater than about 14 degrees and less than about 18 degrees, more preferably about 16 degrees. FIG. 4 also shows the CG 402 of the exemplary 3 fairway wood type golf club head 400 being placed at a "CG Location Distance" d4 away from the neutral axis 404. Similar to the above discussion, the neutral axis 404 of a golf club head 400 may generally be defined as the axis that passes through the center 406 of the striking face 410 of the golf club head 400, while being normal to the striking face 110 that has a loft angle Φ. Here, within this current exemplary embodiment of the present invention, the distance d4, signifying the CG 402 location distance away from the neutral axis 404, may generally be less than about 8.0 mm and greater than about 5.0 mm, most preferably about 7.2 mm. The volume of a 3 fairway wood type golf club head 400 may generally be greater than about 165 cc and less than about 250 cc, more preferably about 170 cc. Finally, the 3 fairway wood type golf club head 400 may generally have a backspin rate of about 3600 rpm when striking a golf ball with a velocity of about 80 mph to about 85 mph with an attack angle of between about −2 degrees to about 2 degrees.

Figure 5:
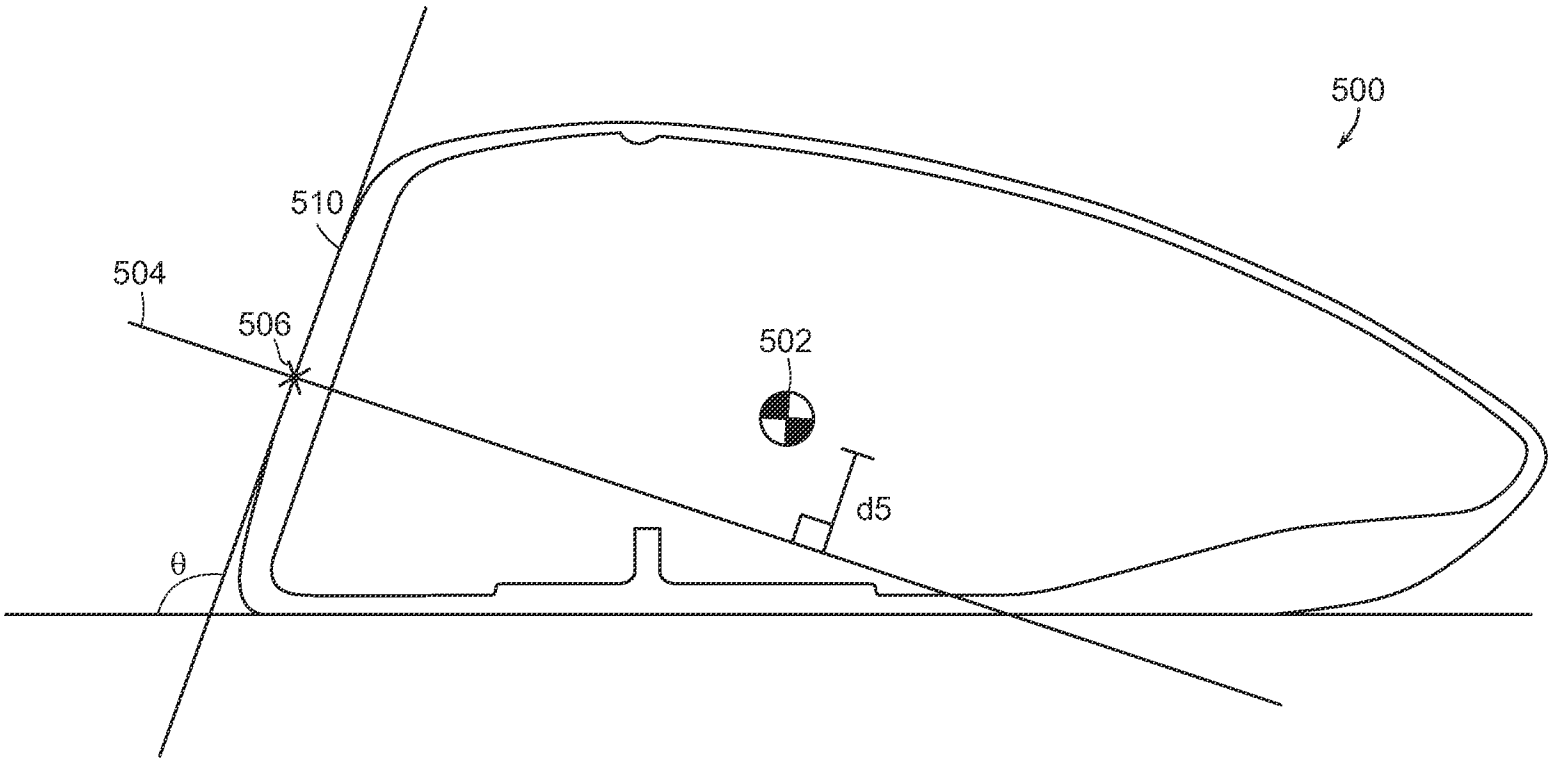
FIG. 5 is a cross-sectional view of a 5 fairway wood type golf club head in accordance with an exemplary embodiment of the present invention.

FIG. 5 shows a 5 fairway wood type golf club head 500 in accordance with an exemplary embodiment of the present invention with a loft angle θ. Because FIG. 5 shows a 5 fairway wood type golf club head 500, the loft angle θ in accordance with this exemplary embodiment of the present invention may generally be greater than about 16 degrees and less than about 20 degrees, more preferably about 18 degrees. FIG. 5 also shows the CG 502 of the exemplary 5 fairway wood type golf club head 500 being placed at a "CG Location Distance" d5 away from the neutral axis 505. Here, within this current exemplary embodiment of the present invention, the distance d5 may generally be less than about 8.0 mm and greater than about 5.0 mm, most preferably about 7.7 mm. The volume of a 5 fairway wood type golf club head 500 may generally be greater than about 160 cc and less than about 170 cc, more preferably about 165 cc. Finally, the 5 fairway wood type golf club head 500 may generally have a backspin rate of about 3900 rpm when striking a golf ball with a velocity of about 80 mph to about 85 mph with an attack angle of between about −2 degrees to about 2 degrees.

Figure 6:
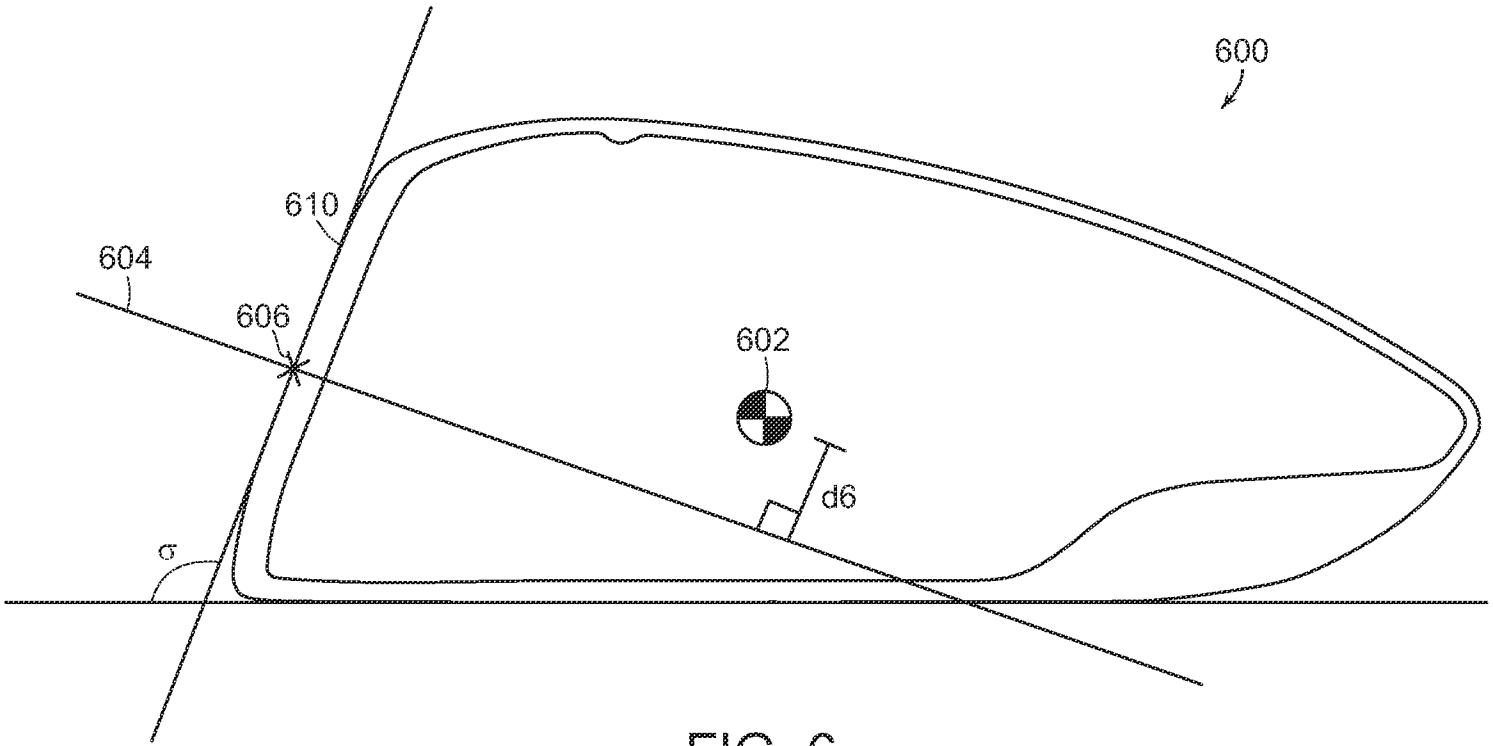
FIG. 6 is a cross-sectional view of a 7 fairway wood type golf club head in accordance with an exemplary embodiment of the present invention.

FIG. 6 shows a 7 fairway wood type golf club head 600 in accordance with an exemplary embodiment of the present invention with a loft angle σ. Because FIG. 6 shows a 7 fairway wood type golf club head 600, the loft angle σ in accordance with this exemplary embodiment of the present invention may generally be greater than about 18 degrees and less than about 24 degrees, more preferably about 20 degrees. FIG. 6 also shows the CG 602 of the exemplary 7 fairway wood type golf club head 600 being placed at a "CG Location Distance" d6 away from the neutral axis. Here, within this current exemplary embodiment of the present invention, the distance d6 may generally be less than about 8.0 mm and greater than about 5.0 mm, most preferably about 7.9 mm. The volume of a 7 fairway wood type golf club head 600 may generally be greater than about 110 cc and less than about 165 cc, more preferably about 159 cc. Finally, the 7 fairway wood type golf club head 600 may generally have a backspin rate of about 4200 rpm when striking a golf ball with a velocity of about 80 mph to about 85 mph with an attack angle of between about −2 degrees to about 2 degrees.

Looking at the amount of spin generated by the fairway wood type golf club heads 400, 500, and 600 in accordance with the exemplary embodiment of the present invention, it may be apparent that the amount of spin generated by the 3 fairway wood type golf club head 400, the 5 fairway wood type golf club head 500, and the 7 fairway wood type golf club head 600 are substantially similar. More specifically the 5 fairway wood type golf club head in accordance with an exemplary embodiment of the present invention 500 may generate only about 300 rpm more backspin than the 3 fairway wood type golf club head 400 while the 7 fairway wood type golf club head 600 may generate only about 300 rpm more backspin than the 5 fairway wood type golf club head 500. Ultimately, within the plurality of golf club heads in accordance with an exemplary embodiment of the present invention, the change in the amount of backspin between any two clubs within the plurality of fairway wood type golf club head may generally be less than about 600 rpm. These backspin figures, when compared to prior art fairway wood type golf club heads 100, 200, and 300, may generally change significantly less. As previously mentioned, controlling the amount of backspin of a plurality of fairway wood type golf club heads may be beneficial, as minimized spin variation provides more distance for each and every single club within the set. In addition to providing more distance, the decrease in spin variation between different fairway wood type golf club heads may generally minimize the distance gaps between the different clubs; which benefits a golfer by allowing him to execute a variety of different golf shots.

Another important improvement of fairway wood type golf club heads in accordance with an exemplary embodiment of the present invention is the reduction in change of CG location distance away from the neutral axis. Having less of a variation of the CG location distance from the neutral axis within a set of fairway wood type golf club 400, 500, and 600 may be beneficial to control the excessive spin and ballooning effect generally associated with higher lofted fairway wood type golf club heads. More specifically, the difference between any of the CG location distance d4, d5, and d6 within the plurality of golf club heads may generally be less than about 1.00 mm. Take for example, the difference between distance d4 and distance d5 may generally be about 0.49 mm while the distance between d5 and d6 may generally be about 0.3 mm. Even the CG location distance between d4 and d6 may generally be less than about 0.79 mm. Because of the tighter variation of the location of the CG location away from the central axis, the spin rate difference between the different clubs may generally be minimized; yielding in a maximized distance by reducing the ballooning effect in fairway type golf club heads.

Controlling and minimizing the change in CG location distance between the different fairway wood type golf club heads 400, 500, and 600 may generally be accomplished by placing the discretionary weight of the golf club head at a location that helps move the CG location closer to the neutral axis. More specifically, because of the fairway wood type golf club heads have a smaller volume and size, there is sufficient discretionary weight within the golf club head to help shift the location of the CG closer to the neutral axis. However, having the CG location closer to the neutral axis can not be achieved merely by moving the CG location lower and further back, as described by the prior art. Although moving the CG location lower may help bring the CG location distance closer to the neutral axis, moving the CG location further back as described in the prior art may actually bring the CG location away from the neutral axis. A closer examination of the angle of the neutral axis being normal to the loft angle of the striking face of the golf club head may help explain this phenomenon, as the loft angle of the striking face may generally cause the neutral axis to be lower towards the rear of the golf club head.

Considering the reduction in CG location distance as well as the spin figures discussed above, an important performance ratio can be obtained describing the relationship between the individual clubs within a plurality of fairway wood type golf club heads. This important performance ratio may generally be referred to as the Spin to Loft Ratio as shown below in Equation 1:

$$\text{Spin to Loft Ratio} = \frac{\text{Spin}}{\text{Loft}} \qquad \text{Eq. 1}$$

The Spin to Loft Ratio of a golf club head may be important to the performance of a golf club head, as it captures the ability of a golf club head to maintain distance and control of a golf club while limiting the dreaded ballooning effect that tends to occur in a higher lofted fairway wood type golf club head. Based on the spin and loft numbers discussed above, A 3 fairway wood type golf club head 400 in accordance with an exemplary embodiment of the present invention may generally have a spin to loft ratio of greater than about 229 rpm/degrees and less than about 230 rpm/degrees, more preferably about 225 rpm/degrees, a 5 fairway wood type golf club head 500 in accordance with an exemplary embodiment of the present invention may generally have a spin to loft ratio of greater than about 210 rpm/degrees and less than about 220 rpm/degrees, more preferably about 215 rpm/degrees, and a 7 fairway wood type golf club head 600 in accordance with an exemplary embodiment of the present invention may generally have a spin to loft ratio of greater than about 205 rpm/degrees and less than about 215 rpm/degrees, more preferably about 210 rpm/degrees.

One interesting result of the plurality of golf club heads in accordance with an exemplary embodiment of the present invention is that the Spin to Loft Ratio decreases as the loft of the each individual club increases. This decrease in Spin to Loft Ratio usually results because the set of fairway type golf club heads in accordance with the exemplary embodiment of the present invention does a better job at maintaining the amount of spin generated by the different fairway type golf club heads within the set. Additionally, the change in Spin to Loft Ratio between any two golf club heads within the set may generally be less than 14 rpm/degrees, more preferably less than about 12 rpm/degrees, and most preferably less than about 10 rpm/degrees all without departing from the scope and content of the present invention.

Due to the fact the amount of spin generated by a fairway wood type golf club head is so closely related to the CG location distance away from the neutral axis, maintaining this CG location away from the neutral axis within a plurality set of fairway wood type golf club head is one of the most important ways to control the undesirable excessive spin and ballooning effect. One of the best ways to quantify the relationship of having a consistent CG location distance through the plurality of different fairway wood type golf club heads is through a volume over CG Location Distance Ratio shown below in Equation 2:

$$\text{Volume to } CG \text{ Location Distance Ratio} = \frac{\text{Volume}}{CG \text{ Distance from Neutral Axis}} \qquad \text{Eq. 2}$$

The volume to CG Location Distance Ratio may be important to a fairway wood type golf club because it provides a easily measurable and quantifiable parameter in the form of distance of the CG location. A 3 fairway wood type golf club head 400 in accordance with an exemplary embodiment of the present invention may generally have a volume to CG location distance ratio of greater than about 225 $cm^2$ and less than about 245 $cm^2$, more preferably about 235 $cm^2$, 5 fairway wood type golf club head 500 in accordance with an exemplary embodiment may generally have a volume to CG location distance ratio of greater than about 202 $cm^2$ and less than about 222 $cm^2$, more preferably about 212 $cm^2$, and a 7 fairway wood type golf club head 600 in accordance with an exemplary embodiment of the present invention may generally have a volume to CG location distance ratio of greater than about 184 $cm^2$ and less then about 204 $cm^2$, most preferably about 194 $cm^2$.

Because the CG location distance away from the neutral axis is closely related to the amount of spin generated by a fairway wood type golf club head, keeping the location of the CG less than about 8.0 mm away from the neutral axis regardless of the volume changes of the different fairway wood type golf club head will ensure consistent backspin characteristics throughout the plurality of fairway wood type golf clubs. More specifically, it is even more desirable to keep the change in Volume to CG Location Distance ratio less than about 50 $cm^2$ between any two clubs within the let, more preferably less than about 48 $cm^2$, and most preferably less than about 46 $cm^2$, all without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the foregoing portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desirable properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A plurality of golf club heads comprising:

a first golf club head comprising;

a first striking face located at a front portion of said first golf club head, wherein said first striking face has a first loft angle of greater than about 14 degrees and less than about 24 degrees; and wherein said first striking face has a first face center defining a first neutral axis normal to said first striking face passing through said first face center, and a first center of gravity located at a first CG location distance away from said first neutral axis, and a second golf club head comprising;

a second striking face located at a front portion of said second golf club head, wherein said second striking face has a second loft angle of greater than about 14 degrees and less than about 24 degrees, wherein said second loft angle is different than said first loft angle; and wherein said second striking face has a second face center defining a second neutral axis normal to said second striking face passing through said second face center, and a second center of gravity located at a second CG location distance away from said second neutral axis, wherein said first golf club head and said second golf club head both have a volume of greater than about 110 cc and less than about 250 cc, and wherein a difference between said first CG location distance and said second CG location distance is less than about 1.00 mm.

2. The plurality of golf club heads of claim 1, wherein said difference between said first CG location distance and said second CG location distance is less than about 0.75 mm.

3. The plurality of golf club heads of claim 1, wherein a difference in a volume to CG location distance ratio between said first golf club head and said second golf club head is less than about 50 $cm^2$;

wherein said volume to CG location distance ratio is defined as said volume of said golf club head divided by said center of gravity location measured away from said neutral axis.

4. The plurality of golf club heads of claim 3, wherein said difference in said volume to CG location distance ratio between said first golf club head and said second golf club head is less than about 48 $cm^2$.

5. The plurality of golf club heads of claim 4, wherein said difference in said volume to CG location distance ratio between said first golf club head and said second golf club head is less than about 46 $cm^2$.

6. The plurality of golf club heads of claim 3, wherein said first loft angle is greater than said second loft angle, and wherein a first spin to loft ratio of said first golf club head is less than a second spin to loft ratio of said second golf club head;

wherein said spin to loft ratio is defined as a backspin of a golf ball after being impacted by said golf club head divided by said loft angle of said golf club head.

7. The plurality of golf club heads of claim 6, wherein said backspin is generated by swinging said golf club head at a velocity of between about 80 mph to about 85 mph with an attack angle of between about −2 degrees to about 2 degrees.

8. The plurality of golf club heads of claim 1, wherein said first CG location distance and said second CG location distance are less than about 8.0 mm and greater than about 5.0 mm.

9. A plurality of golf club heads comprising:

a first golf club head comprising;

a first striking face located at a front portion of said first golf club head, wherein said first striking face has a first loft angle of greater than about 14 degrees and less than about 24 degrees; and wherein said first striking face has a first face center defining a first neutral axis normal to said first striking face passing through said first face center, and a first center of gravity located at a first CG location distance away from said first neutral axis, and a second golf club head comprising;

a second striking face located at a front portion of said second golf club head, wherein said second striking face has a second loft angle of greater than about 14 degrees and less than about 24 degrees, wherein said second loft angle is different than said first loft angle; and wherein said second striking face has a second face center defining a second neutral axis normal to said second striking face passing through said second face center, and a second center of gravity located at a second CG location distance away from said second neutral axis, wherein said first golf club head and said second golf club head both have a volume of greater than about 110 cc and less than about 250 cc;

wherein a difference in a volume to CG location distance ratio between said first golf club head and said second golf club head is less than about 50 $cm^2$; and wherein said volume to CG location distance ratio is defined as said volume of said golf club head divided by said center of gravity location measured away from said neutral axis.

10. The plurality of golf club heads of claim 9, wherein said difference in said volume to CG location distance ratio between said first golf club head and said second golf club head is less than about 48 $cm^2$.

11. The plurality of golf club heads of claim 10, wherein said difference in said volume to CG location distance ratio between said first golf club head and said second golf club head is less than about 46 $cm^2$.

12. The plurality of golf club heads of claim 9, wherein said first loft angle is greater than said second loft angle, and wherein a first spin to loft ratio of said first golf club head is less than a second spin to loft ratio of said second golf club head;

wherein said spin to loft ratio is defined as a backspin of a golf ball after being impacted by said golf club head divided by said loft angle of said golf club head.

13. The plurality of golf club heads of claim 12, wherein said backspin is generated by swinging said golf club head at a velocity of between about 80 mph to about 85 mph with an attack angle of between about −2 degrees to about 2 degrees.

14. The plurality of golf club heads of claim 9, wherein said first CG location distance and said second CG location distance are less than about 8.0 mm and greater than about 5.0 mm.

* * * * *